US011761253B2

(12) United States Patent
Soderqvist

(10) Patent No.: US 11,761,253 B2
(45) Date of Patent: Sep. 19, 2023

(54) FINGER PINCH PROTECTION FOR AN ENTRANCE SYSTEM

(71) Applicant: Assa Abloy Entrance Systems AB, Landskrona (SE)

(72) Inventor: Sven-Gunnar Soderqvist, Vallakra (SE)

(73) Assignee: Assa Abloy Entrance Systems AB, Landskrona (SE)

( * ) Notice: Subject to any disclaimer, the term of this patent is extended or adjusted under 35 U.S.C. 154(b) by 175 days.

(21) Appl. No.: 17/046,861

(22) PCT Filed: Apr. 12, 2019

(86) PCT No.: PCT/EP2019/059365

§ 371 (c)(1),
(2) Date: Oct. 12, 2020

(87) PCT Pub. No.: WO2019/201757

PCT Pub. Date: Oct. 24, 2019

(65) Prior Publication Data

US 2021/0180384 A1 Jun. 17, 2021

(30) Foreign Application Priority Data

Apr. 16, 2018 (SE) ..... 1830124-2

(51) Int. Cl.
*E05F 15/00* (2015.01)
*E05F 15/40* (2015.01)
(Continued)

(52) U.S. Cl.
CPC ..... *E05F 15/40* (2015.01); *E05F 15/63* (2015.01); *E05F 15/74* (2015.01);
(Continued)

(58) Field of Classification Search
CPC . E05F 15/40; E05F 15/63; E05F 15/74; E05F 2015/763; E05F 2015/765;
(Continued)

(56) References Cited

U.S. PATENT DOCUMENTS 4,967,083 A * 10/1990 Kornbrekke ..... G01S 17/50 250/221
5,142,152 A * 8/1992 Boiucaner ..... E05F 15/43 250/221

(Continued)

FOREIGN PATENT DOCUMENTS

DE 102015104818 7/2016
EP 0380187 8/1990

(Continued)

OTHER PUBLICATIONS

Swedish Search Report mailed in SE 1830124-2 dated Oct. 17, 2018.

(Continued)

*Primary Examiner* — Jerry E Redman
(74) *Attorney, Agent, or Firm* — Wissing Miller LLP

(57) ABSTRACT

Disclosed is a method (50) of providing finger pinch protection at a hinge area of a swing door-based entrance system (1) having a motorized automatic door operator (30) for opening (2) of the swing door (10) in an automatic mode of the entrance system (1), wherein the entrance system (1) also has a manual mode in which a human user may cause opening and closing of the swing door (10) by manual force. The method involves monitoring (52), by a first sensor function (S1), for presence of a person or object in a first zone (PD) at the first door leaf surface (12-1) and non-proximate to a vertical door edge (14). The method also involves monitoring, by a second sensor function (S2), for presence of a person or object in a second zone (PDHA) at the first door leaf surface (12-1) and proximate to said
(Continued)

vertical door edge (14). When any of the first sensor function (S1) or second sensor function (S2) detects presence in the first zone (PD) or second zone (PDHA) in the automatic mode during an ongoing opening of the swing door (10), the automatic door operator (30) is controlled so as to stop opening of the swing door (10). When the second sensor function (S2) detects presence in the second zone (PDHA) in the manual mode, the automatic door operator (30) is controlled so as to counteract an attempt by a human user to manually open the swing door (10). A corresponding entrance system (1) is also disclosed.

11 Claims, 7 Drawing Sheets

(51) Int. Cl.
*E05F 15/63* (2015.01)
*E05F 15/74* (2015.01)
*E05F 15/73* (2015.01)

(52) U.S. Cl.
CPC ... *E05F 2015/763* (2015.01); *E05F 2015/765* (2015.01); *E05F 2015/767* (2015.01); *E05Y 2201/422* (2013.01); *E05Y 2201/43* (2013.01); *E05Y 2400/40* (2013.01); *E05Y 2400/44* (2013.01); *E05Y 2400/54* (2013.01); *E05Y 2600/46* (2013.01); *E05Y 2800/116* (2013.01); *E05Y 2900/132* (2013.01)

(58) Field of Classification Search
CPC ..... E05F 2015/767; E05F 2015/433; E05Y 2201/422; E05Y 2201/43; E05Y 2400/40; E05Y 2400/44; E05Y 2400/54; E05Y 2800/116; E05Y 2900/132
USPC ..... 49/25
See application file for complete search history.

(56) References Cited

U.S. PATENT DOCUMENTS 5,963,000 A * 10/1999 Tsutsumi ..... E05F 15/43 250/221
6,678,999 B2 * 1/2004 Zengguang ..... G01S 17/04 49/25
6,970,085 B2 * 11/2005 Okabe ..... E05F 15/74 340/545.1
7,064,666 B2 * 6/2006 Sasaki ..... E05F 15/43 250/221
8,225,458 B1 7/2012 Hoffberg
8,904,708 B2 * 12/2014 Zacchio ..... E05F 15/73 49/25
9,163,446 B2 * 10/2015 Houser ..... E05F 15/40
9,341,013 B2 * 5/2016 Iwata ..... E05F 15/73
10,975,608 B2 * 4/2021 Walser ..... G01S 7/497
2002/0036476 A1 * 3/2002 Zengguang ..... G01S 17/04 340/556
2004/0140782 A1 7/2004 Okabe
2009/0313897 A1 * 12/2009 Mezger ..... E05F 15/73 49/25
2010/0115853 A1 5/2010 Gebhart
2010/0242368 A1 * 9/2010 Yulkowski ..... E05F 15/63 49/349
2010/0253516 A1 * 10/2010 Lemerand ..... E05F 15/73 340/545.1
2013/0269255 A1 * 10/2013 De Coi ..... E05F 15/74 49/25
2015/0059248 A1 3/2015 Iwata
2015/0059249 A1 * 3/2015 Yulkowski ..... E05F 15/50 49/31
2015/0128496 A1 * 5/2015 Phillips ..... E05B 65/108 49/31
2022/0268084 A1 * 8/2022 Wegner ..... E05F 15/73

FOREIGN PATENT DOCUMENTS

EP 2009215 12/2008
EP 2226452 9/2010
EP 2540947 1/2013
EP 2648022 A1 * 10/2013 ..... E05F 15/203

OTHER PUBLICATIONS

International Search Report and Written Opinion mailed in PCT/EP2019/059365 dated Jul. 17, 2019.

* cited by examiner

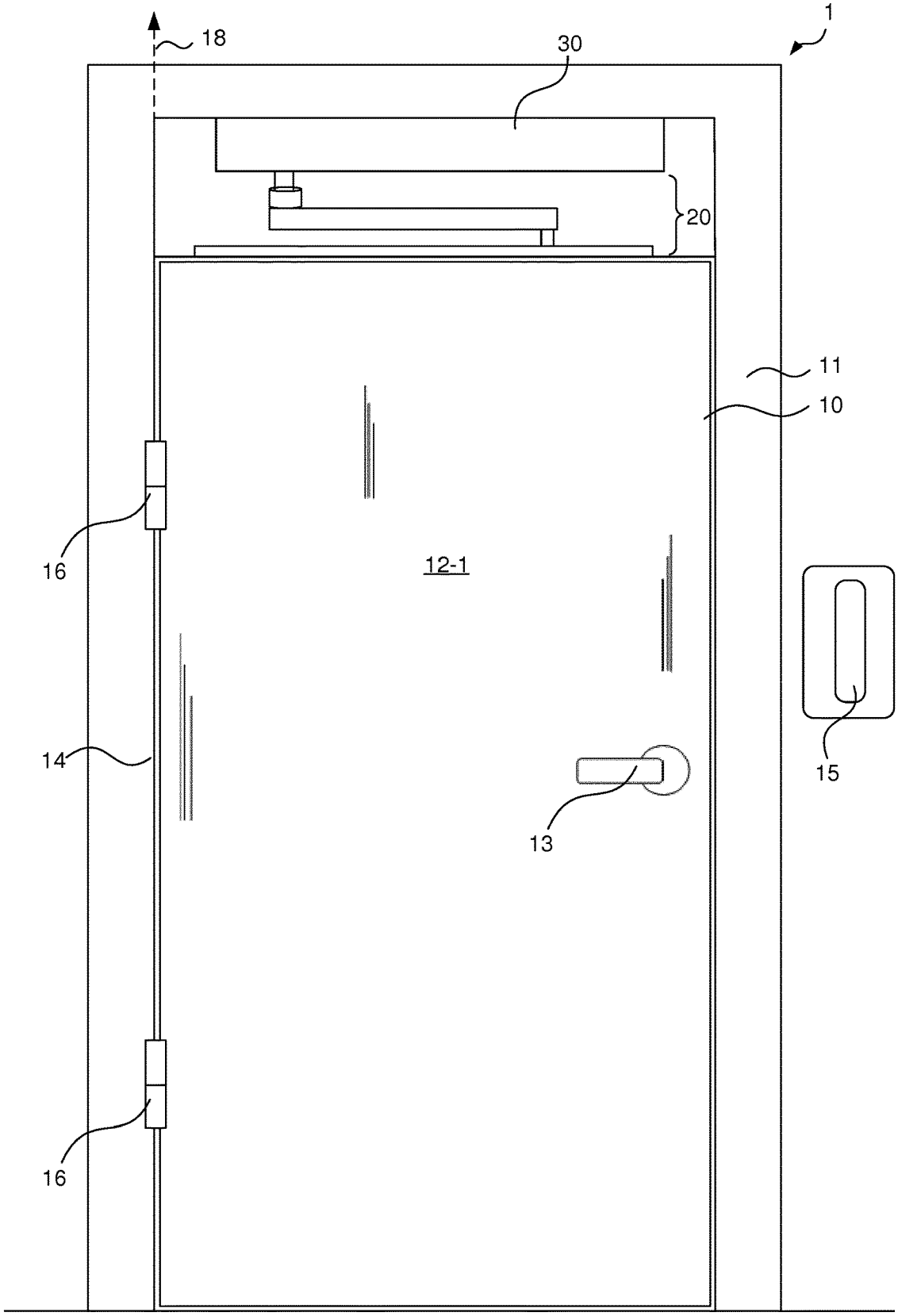
Fig 1A - Prior Art

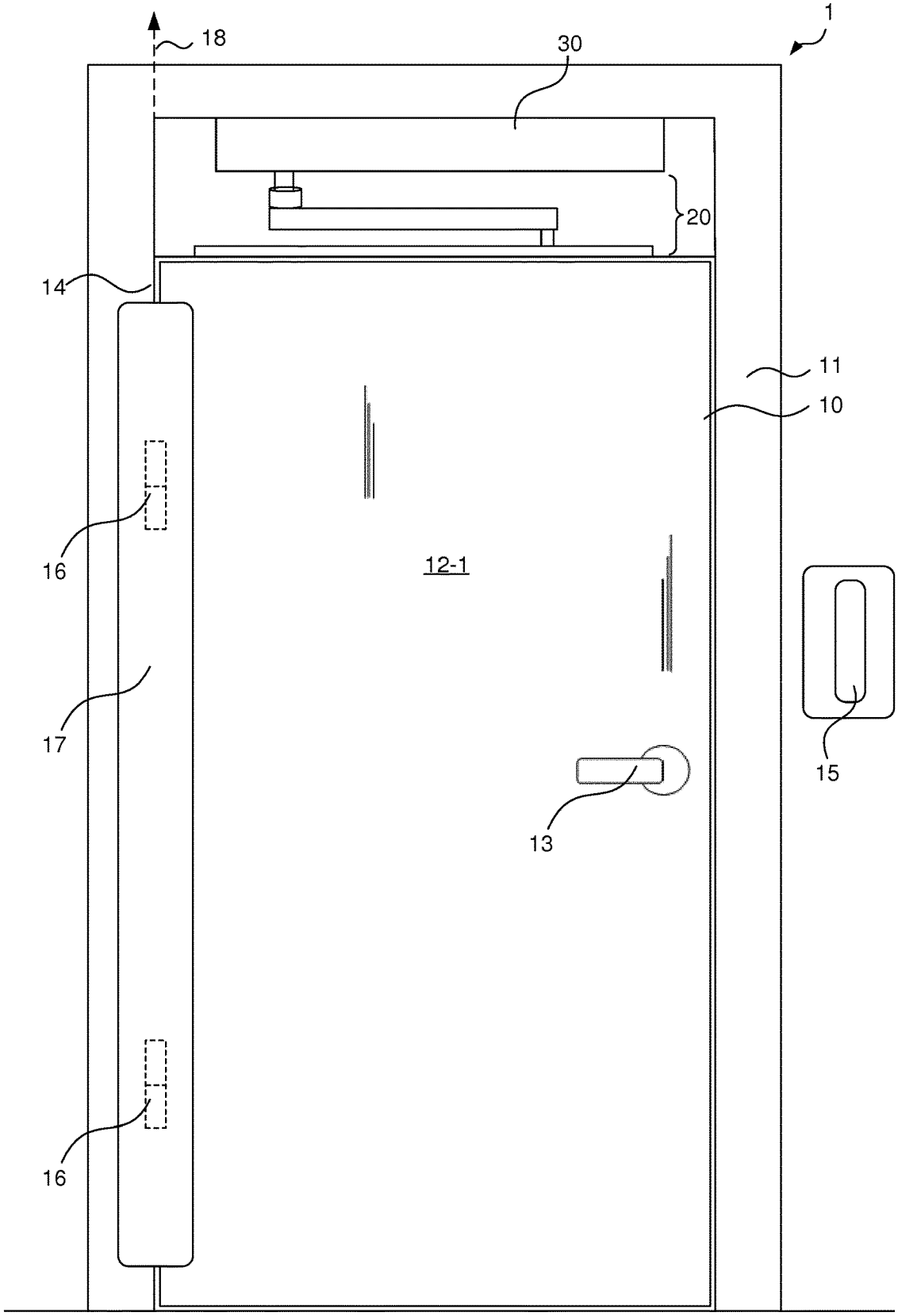
Fig 1B - Prior Art

A method of providing finger pinch protection at a hinge area of a swing door-based entrance system:

FINGER PINCH PROTECTION FOR AN ENTRANCE SYSTEM

This application is a 371 of PCT/EP2019/059365 filed on Apr. 12, 2019, published on Oct. 24, 2019 under publication number WO 2019/206757, which claims priority benefits from Swedish Patent Application No. 1830124-2, filed on Apr. 16, 2018, the disclosure of which is incorporated herein by reference.

TECHNICAL FIELD

The present invention generally relates to entrance systems. More specifically, present invention relates to entrance systems of the type which has a swing door being pivotally supported at a vertical door edge (also known as a secondary closing edge) by at least one hinge for allowing opening of the swing door from a closed position to an open position, as well as for allowing closing of the swing door from the open position to the closed position. This type of entrance systems furthermore has an automatic door operator comprising a motor capable of causing opening of the swing door in an automatic mode of the entrance system, wherein the entrance system also has a manual mode in which a human user may cause opening and closing of the swing door by manual force. The present invention also relates to a method of providing finger pinch protection at a hinge area of such a swing door-based entrance system.

BACKGROUND

Entrance systems having automatic door operators are frequently used for providing automatic opening, and sometimes closing, of one or more swing doors in order to facilitate entrance and exit to buildings, rooms and other areas.

FIG. 1A is a schematic front view of a swing door-based entrance system 1 according to the prior art. The entrance system 1 comprises a swing door 10 having a first door leaf surface 12-1 and an opposing second door leaf surface (not seen in FIG. 1A). The swing door 10 is pivotally supported at a vertical door edge 14, also known as a secondary closing edge, by hinges 16 for allowing opening of the swing door 10 from a closed position to an open position, as well as for allowing closing of the swing door 10 from the open position to the closed position. The swing door 10 is hence supported by a door frame 11 for pivotal motion around a rotational axis 18 which is coincident with the hinges 16.

The entrance system 1 also comprises a motorized automatic door operator 30 capable of causing opening of the swing door 10 in an automatic mode of the entrance system 1. A linkage mechanism 20 connects the automatic door operator 30 to the swing door 10. The door operator 30 may be arranged in conjunction with the door frame 11, typically as a concealed overhead installation in or at the door frame 11.

The automatic mode may be triggered by sensor equipment in the entrance system 1, such as, for instance, a door-open push button 15, radar or an IR motion detector. The entrance system 1 also has a manual mode in which a human user may open or close the swing door 10 by pulling or pushing a door handle 13 by manual force, i.e. without using the motorized automatic door operator 30.

The automatic door operator 30 may provide automatic opening of the swing door 10 in various possible applications. Such applications includes, for instance, facilitating a disabled person's access to his or her private home, providing access through entrance ports or internal doors at healthcare buildings, office premises, industries or retail stores, providing comfort access to hotel rooms, etc. The automatic door operator 30 may also be used in fire door applications.

Since entrance systems with automatic door operators are typically used in public areas, user safety is crucial. Hazardous situations should be avoided so that a present, approaching or departing person or object (including but not limited to pets or articles brought by the person) will not be hit or jammed by the movable swing door.

One particular risk is at the hinges 16 of the movable swing door, i.e. in a narrow space at the vertical door edge 14 (secondary closing edge) near the hinges 16 that support the swing door 10 for pivotal motion. Human fingers, especially children's, are thin enough to fit in this space. If a finger is kept in this space while the swing door 10 is moved, the finger may be pinched, and thus severely damaged, between the door frame 11 and the vertical door edge 14.

As can be seen in FIG. 1B, finger pinch protection in the prior art has been achieved by the use of mechanical protective guards 17 in the form of cover elements mounted to the frame 11 and the door 10 and covering the narrow space at the vertical door edge (secondary closing edge) 14 of the door. A mechanical protective guard 17 may, for instance but without limitation, extend between 15 mm from the bottom edge of the door 10 and 2 m above floor level. While mechanical protective guards 17 serve their purpose as such, they are disadvantageous for aesthetical reasons and sometimes also because they are difficult to install in the particular environment where the entrance system 1 is located. In addition, mechanical protective guards 17 are subjected to wear and tear, or vandalism, and their protective function may therefore degrade or even be lost over time.

Some attempts have been made in the prior art to monitor a swing door by using optical sensors which may abort the operation of the automatic door operator during door movement in automatic mode. A drawback with such attempts is that there will be no protection in situations where a human user opens or closes the swing door by manual force.

The present inventors have realized that there is room for improvements in this field.

SUMMARY

An object of the present invention is therefore to provide one or more improvements when it comes to finger pinch protection for swing door-based entrance systems.

Accordingly, a first aspect of the present invention is an entrance system comprising a swing door having opposing first and second door leaf surfaces and being pivotally supported at a vertical door edge, also known as a secondary closing edge, by at least one hinge for allowing opening of the swing door from a closed position to an open position with the first door leaf surface being a leading surface and the second door leaf surface being a trailing surface during such opening, as well as for allowing closing of the swing door from the open position to the closed position.

The entrance system also has an automatic door operator comprising a motor capable of causing opening of the swing door in an automatic mode of the entrance system, wherein the entrance system also has a manual mode in which a human user may cause opening and closing of the swing door by manual force.

Moreover, the entrance system has a control arrangement for controlling the automatic door operator. The control arrangement comprises a controller and a plurality of sensor functions for monitoring respective zones at the entrance system for presence of a person or object. The sensor functions comprise a first sensor function for monitoring a first zone at the first door leaf surface and non-proximate to said vertical door edge, and a second sensor function for monitoring a second zone at the first door leaf surface and proximate to said vertical door edge.

The controller of the control arrangement is configured to stop opening of the swing door when any of the first sensor function or second sensor function detects presence in the first zone or second zone in the automatic mode during an ongoing opening of the swing door. When the second sensor function detects presence in the second zone in the manual mode, the controller is moreover configured to control the automatic door operator to counteract an attempt by a human user to manually open the swing door.

The provision of an entrance system with such a control arrangement will solve or at least mitigate one or more of the problems or drawbacks identified in the above, as will be clear from the following detailed description and the drawings. Finger pinch protection is obtained without the need for mechanical protective guards, and yet protection is enabled both when the entrance system operates in automatic mode, and when a human user actuates the door by manual force.

A second aspect of the present invention is a method of providing finger pinch protection at a hinge area of a swing door-based entrance system having a motorized automatic door operator for opening of the swing door in an automatic mode of the entrance system, the entrance system also having a manual mode in which a human user may cause opening and closing of the swing door by manual force.

The method comprises monitoring, by a first sensor function, for presence of a person or object in a first zone at the first door leaf surface and non-proximate to a vertical door edge. The method also comprises monitoring, by a second sensor function, for presence of a person or object in a second zone at the first door leaf surface and proximate to said vertical door edge.

When any of the first sensor function or second sensor function detects presence in the first zone or second zone in the automatic mode during an ongoing opening of the swing door, the method comprises controlling the automatic door operator to stop opening of the swing door. Correspondingly, when the second sensor function detects presence in the second zone in the manual mode, the method comprises controlling the automatic door operator to counteract an attempt by a human user to manually open the swing door.

Embodiments of the invention are defined by the appended dependent claims and are further explained in the detailed description as well as in the drawings.

It should be emphasized that the term "comprises/comprising" when used in this specification is taken to specify the presence of stated features, integers, steps, or components, but does not preclude the presence or addition of one or more other features, integers, steps, components, or groups thereof. All terms used in the claims are to be interpreted according to their ordinary meaning in the technical field, unless explicitly defined otherwise herein. All references to "a/an/the [element, device, component, means, step, etc]" are to be interpreted openly as referring to at least one instance of the element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

Objects, features and advantages of embodiments of the invention will appear from the following detailed description, reference being made to the accompanying drawings.

FIG. 1A is a schematic block diagram of a swing-door based entrance system generally according to the prior art.

FIG. 1B is a schematic block diagram of a swing-door based entrance system generally according to the prior art.

DETAILED DESCRIPTION OF EMBODIMENTS

Figure 2A:
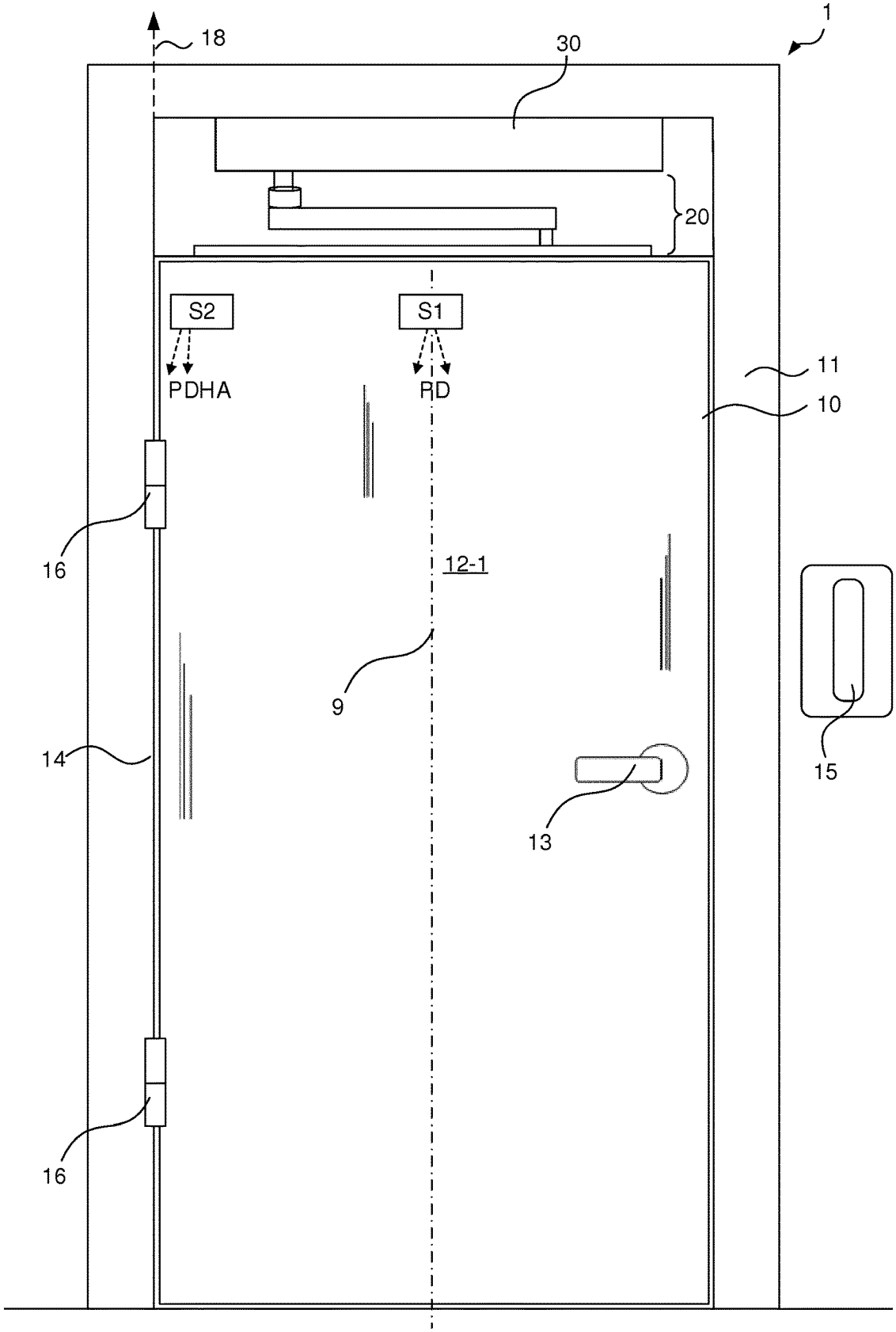
FIG. 2A is a schematic block diagram of a swing-door based entrance system according to an embodiment of the present invention.

Embodiments of the invention will now be described with reference to the accompanying drawings. The invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the particular embodiments illustrated in the accompanying drawings is not intended to be limiting of the invention. In the drawings, like numbers refer to like elements.

FIG. 2A is a schematic block diagram illustrating a swing-door based entrance system 1 according to an embodiment of the present invention. Like the prior art entrance systems previously described with reference to FIGS. 1A and 1B, the entrance system 1 in FIG. 2A comprises a swing door 10 having a first door leaf surface 12-1 and an opposing second door leaf surface 12-2 which is not seen in FIG. 2A but is indicated in FIGS. 4-7. The swing door 10 is pivotally supported at a vertical door edge 14, often referred to as the secondary closing edge, by one or more hinges 16 for allowing opening of the swing door 10 from a closed position to an open position, as well as for allowing closing of the swing door 10 from the open position to the closed position. The swing door 10 is hence supported by a door frame 11 for pivotal motion around a rotational axis 18 which is coincident with the hinges 16.

Figure 4:
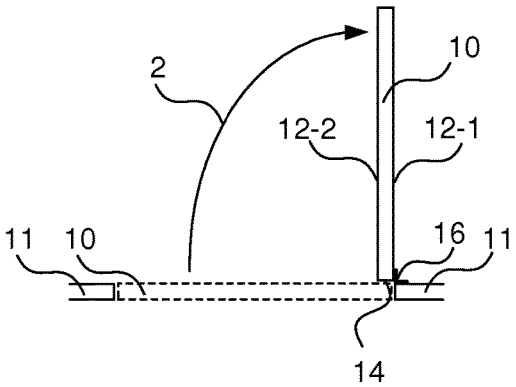
FIG. 4 is a schematic top view illustrating opening of the swing door of the entrance system from a closed position to an open position.

FIG. 4 illustrates the opening of the swing door 10 of the entrance system 1 from a closed position to an open position, the opening movement being indicated by an arrow 2. As can be seen in FIG. 4, during such opening 2 of the swing door 10, the first door leaf surface 12-1 will be a leading surface and the second door leaf surface 12-2 will be a trailing surface.

Figure 5:
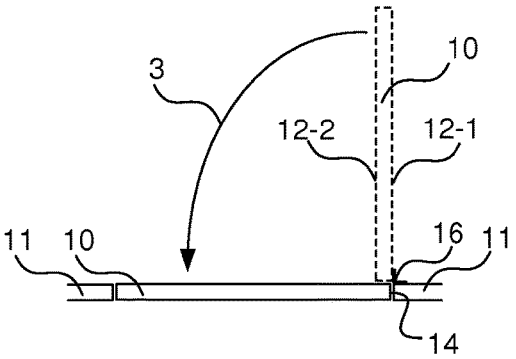
FIG. 5 is a schematic top view illustrating closing of the swing door of the entrance system from the open position to the closed position.

FIG. 5 correspondingly illustrates the closing of the swing door 10 of the entrance system 1 from the open position to the closed position. The closing movement is indicated by an arrow 3.

The entrance system 1 in FIG. 2A also comprises a motorized automatic door operator 30 which is capable of causing opening of the swing door 10 in an automatic mode of the entrance system 1. Like in FIGS. 1A and 1B, a linkage mechanism 20 connects the automatic door operator 30 to the swing door 10. The door operator 30 may be arranged in conjunction with the door frame 11, typically as a concealed overhead installation in or at the door frame 11. The automatic mode may be triggered by sensor equipment in the entrance system 1, such as, for instance, a door-open push button 15, radar or an IR motion detector.

The entrance system 1 also has a manual mode in which a human user may open or close the swing door 10 by pulling or pushing a door handle 13 by manual force, i.e. without using the motorized automatic door operator 30.

As explained already in the Background section, the automatic door operator 30 may provide automatic opening of the swing door 10 in various possible applications, including but not limited to facilitating a disabled person's access to his or her private home, providing access through entrance ports or internal doors at healthcare buildings, office premises, industries or retail stores, providing comfort access to hotel rooms, and fire door applications.

Unlike the prior art entrance system in FIG. 1B, there are no mechanical protective guards at the first door leaf surface 12-1 in the entrance system in FIG. 2A. Instead, finger pinch protection is obtained by the provision of first and second sensor functions S1, S2. The first sensor function S1 is configured to monitor for presence of a person or object in a first zone PD at the first door leaf surface 12-1 and non-proximate to (i.e. at some horizontal distance from) the vertical door edge 14. The second sensor function S2 is configured to monitor for presence of a person or object in a second zone PDHA at the first door leaf surface 12-1 and proximate to the vertical door edge 14. Details about these sensor functions S1, S2 and their functionality and purpose will be given later in the present section of this document. The first and second zones PD, PDHA at the first door leaf surface 12-1 are seen in more detail in FIGS. 6-8.

Figure 3:
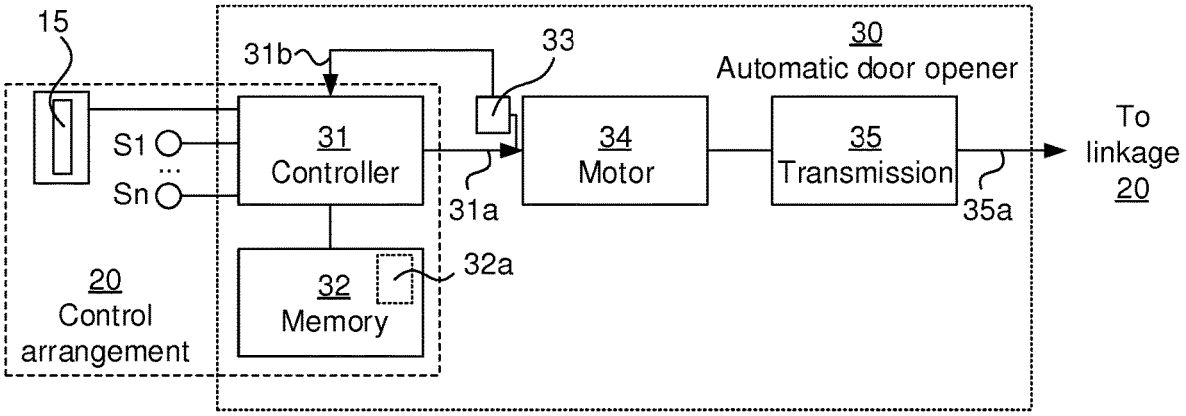
FIG. 3 is a schematic block diagram of an automatic door operator and a control arrangement for the control thereof according to an embodiment.

An embodiment of the automatic door operator 30 is shown in FIG. 3. The automatic door operator 30 comprises a motor 34, typically an electrical motor, being connected to a transmission 35. An output shaft 35*a* of the transmission 35 rotates upon activation of the motor 34 and is connected to the linkage mechanism 20. The linkage mechanism 20 translates the motion of the output shaft 35*a* into an opening motion of the swing door 10 with respect to the door frame 11.

In alternative embodiments, not shown in the drawings, the automatic door operator 30 may furthermore comprise a forced close arrangement which is adapted to provide mechanical energy via a transfer mechanism to the linkage 20, so as to cause forced closing of the door 10 with respect to the door frame 11, for instance in the event of a fire alarm. The forced close arrangement 36 may, for instance, comprise a helical compression spring. During opening of the door 10, the compression spring will be tensioned by the rotation of the output shaft 35*a*. During a forced closing cycle, the accumulated spring force will be transferred to the output shaft 35 by means of the transfer mechanism, for instance in the form of a pressure roller that acts on a cam curve being connected to the output shaft 35*a*.

The automatic door operator 30 also comprises a control arrangement 20 which is configured for controlling the automatic door operator 30 to perform different functions thereof. The control arrangement 20 comprises a controller 31 and a plurality of sensor functions S1 . . . Sn (including or consisting of the aforementioned sensor functions S1 and S2) for monitoring respective zones at the entrance system 10 for presence of a person or object. The sensor functions S1 . . . Sn, as well as other sensor equipment in the entrance system 1 like the door-open push button 15, are operatively connected with the controller 31 to report detection results to the controller 31.

The controller 31 may be implemented in any known controller technology, including but not limited to microcontroller, processor (e.g. PLC, CPU, DSP), FPGA, ASIC or any other suitable digital and/or analog circuitry capable of performing the intended functionality.

The controller 31 has an associated memory 32. The memory 32 may be implemented in any known memory technology, including but not limited to E(E)PROM, S(D)RAM or flash memory. In some embodiments, the memory 32 may be integrated with or internal to the controller 31. The memory 32 may store program instructions for execution by the controller 31, as well as temporary and permanent data used by the controller 31, as can be seen at 32*a* in FIG. 3.

One or more of the functions of the automatic door operator 30 relates to the opening 2 of the swing door 10 with respect to the door frame 11. Accordingly, the controller 31 of the control arrangement 20 has a control output 31*a* connected to the motor 34 for controlling the actuation thereof. A revolution counter 33, such as an encoder or other angular sensor, is provided at the motor 34 to monitor the revolution of a motor shaft of the motor 34. The revolution counter is connected to an input 31*b* of the controller 31. The controller 31 is configured to use one or more readings of the revolution counter 33 for determining a current angular position of the swing door 10.

The controller 31 of the control arrangement 20 is configured to provide finger pinch protection as follows.

1. When any of the first sensor function S1 or second sensor function S2 detects presence in the first zone PD or second zone PDHA in the automatic mode during an ongoing opening of the swing door 10, the controller 31 will control the automatic door operator 30 to stop opening of the swing door 10 by submitting a control signal on the control output 31*a* to cease activation (rotation) of the motor 34. Thereby, a potential pinching of fingers at the vertical door edge 14 may be prevented. In effect, therefore, the first sensor function S1 and second sensor function S2 together act as a combined presence detector for monitoring the area near the first door leaf surface 12-1 in the automatic mode.

2. When the second sensor function S2 detects presence in the second zone PDHA in the manual mode, the controller 31 will control the automatic door operator 30 to counteract an attempt by a human user to manually open the swing door 10. The controller 31 may do this by submitting a control signal on the control output 31*a* to apply a certain torque by the motor 34 to the swing door 10 via the transmission 35 and linkage mechanism 20, thereby generating a force resistance which prevents or at least makes it substantially harder for the human user to continue the manual door opening attempt. Thereby, a potential pinching of fingers at the vertical door edge 14 may be prevented even when the entrance system 1 is in the manual mode.

Figure 6:
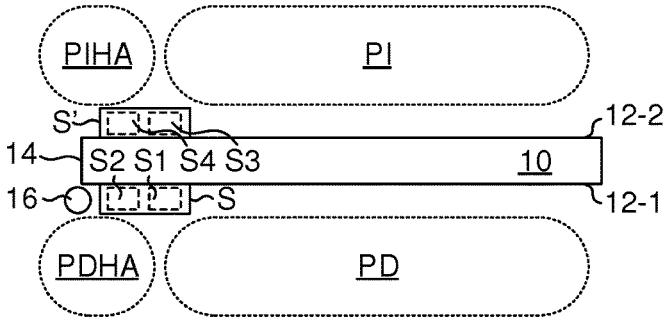
FIG. 6 is a schematic top view illustrating the location of different sensor functions and their respective monitoring zones in a single swing door-based entrance system according to an embodiment.
Figure 7:
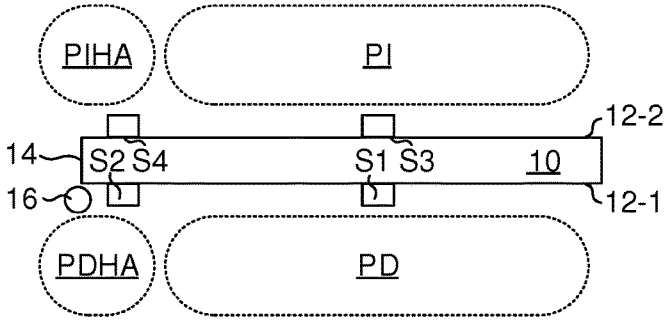
FIG. 7 is a schematic top view illustrating the location of different sensor functions and their respective monitoring zones in a single swing door-based entrance system according to another embodiment.
Figure 8:
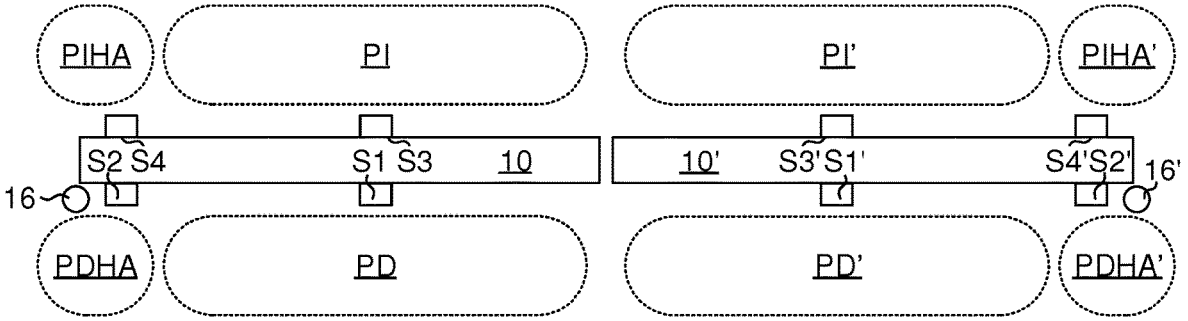
FIG. 8 is a schematic top view illustrating the location of different sensor functions and their respective monitoring zones in a dual swing door-based entrance system according to an embodiment.

Advantageously, the plurality of sensor functions S1 . . . Sn of the control arrangement 20 further comprises a third sensor function S3 being configured to monitor for presence of a person or object in a third zone PI at the second door leaf surface 12-2 and non-proximate to (i.e. at some horizontal distance from) the vertical door edge 14, as well as a fourth sensor function S4 being configured to monitor for presence of a person or object in a fourth zone PIHA at the second door leaf surface 12-2 and proximate to the vertical door edge 14. The third and fourth zones PI, PIHA at the second door leaf surface 12-2 are seen in FIGS. 6-8.

In such embodiments, the controller 31 of the control arrangement 20 is further configured to provide finger pinch protection as follows.

3. When any of the third sensor function S3 or fourth sensor function S4 detects presence in the third zone PI or fourth zone PIHA in the automatic mode during an ongoing closing of the swing door 10, the controller 31 will control the automatic door operator 30 to reopen the swing door 10 by submitting a control signal on the control output 31*a* to resume activation (rotation) of the motor 34. Thereby, a potential pinching of fingers at the vertical door edge 14 may be prevented also for persons appearing at the other side of the swing door 10, i.e. at the second door leaf surface 12-2. In effect, therefore, the third sensor function S3 and fourth sensor function S4 together act as a combined presence detector for monitoring the area near the second door leaf surface 12-2 in the automatic mode.

4. When the fourth sensor function S4 detects presence in the fourth zone PIHA in the manual mode, the controller 31 will control the automatic door operator 30 to counteract an attempt by a human user to manually close the swing door 10. The controller 31 may do this by submitting a control signal on the control output 31*a* to apply a certain torque by the motor 34 to the swing door 10 via the transmission 35 and linkage mechanism 20, thereby generating a force resistance which prevents or at least makes it substantially harder for the human user to continue the manual door closing attempt. Thereby, a potential pinching of fingers at the vertical door edge 14 may be prevented even when the entrance system 1 is in the manual mode, also for persons appearing at the second door leaf surface 12-2.

In one or more advantageous embodiments, the controller 31 of the control arrangement 20 is configured to prioritize the first and second sensor functions S1, S2 over the third and fourth sensor functions S3, S4, such that the controller 31 is configured to control the automatic door operator 30 to reopen the swing door 10 only on condition that none of the first and second sensor functions S1, S2 detects presence in the first zone PD or second zone PDHA in the automatic mode during the ongoing closing of the swing door 10. In other words, the safety functionality provided by means of the first and second sensor functions S1, S2 to prevent finger pinch accidents in the first and second zones PD, PDHA (i.e. the area near the first door leaf surface 12-1) will override the functionality provided by means of the third and fourth sensor functions S3, S4.

Figure 2B:
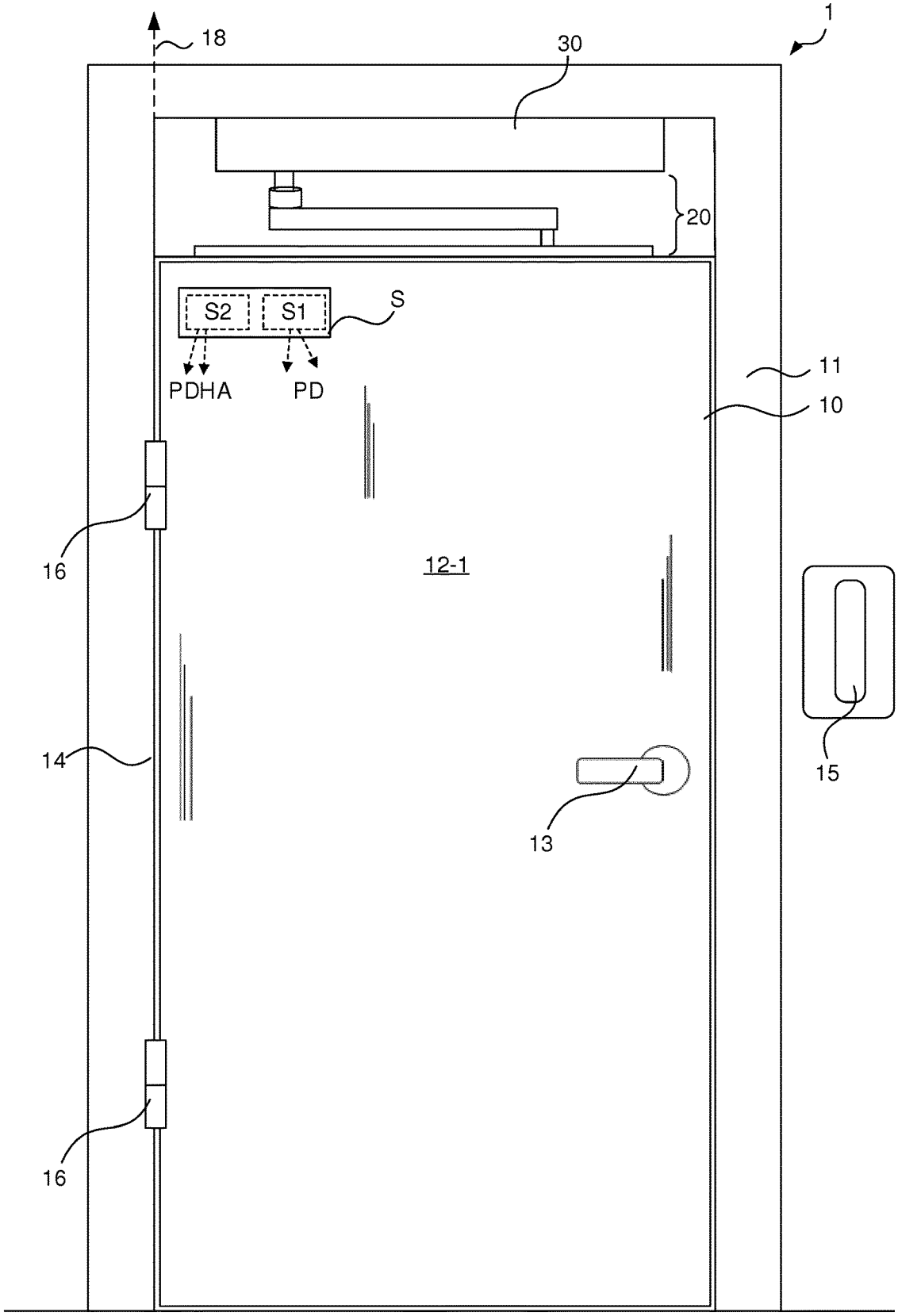
FIG. 2B is a schematic block diagram of a swing-door based entrance system according to another embodiment of the present invention.

In one or more advantageous embodiments, the first and second sensor functions S1, S2 are two logically different sensor functions which are implemented by a single common physical sensor device S. As can be seen in FIG. 2B and also in FIG. 6, the single common physical sensor device S is mounted to an upper part of the first door leaf surface 12-1 near the vertical door edge 14.

Similarly, the third and fourth sensor functions S3, S4 may be two logically different sensor functions implemented by a single common physical sensor device S' being mounted to an upper part of the second door leaf surface 12-2 near the vertical door edge 14. The single common physical sensor device S' can be seen in FIG. 6. Using a single common physical sensor device S or S' to implement two logically different sensor functions S1, S2 or S3, S4 is advantageous, since less equipment is needed. This may also be beneficial from an installation perspective and for aesthetical reasons.

Alternatively, as can be seen in FIG. 2A and also in FIGS. 7 and 8, the first sensor function S1 may be implemented as one physical sensor device being mounted to an upper part of the first door leaf surface 12-1 near the vertical door edge 14, whereas the second sensor function S2 may be implemented as another physical sensor device being mounted to an upper part of the first door leaf surface 12-1 at or near a vertical central axis 9 of the first door leaf surface 12-1. See FIG. 2A.

Likewise, the third sensor function S3 may be implemented as one physical sensor device being mounted to an upper part of the second door leaf surface 12-2 near the vertical door edge 14, whereas the fourth sensor function S4 may be implemented as another physical sensor device being mounted to an upper part of the second door leaf surface 12-2 at or near a vertical central axis of the second door leaf surface 12-2. See FIGS. 7 and 8.

Each of the first, second, third and fourth sensor functions S1-S4 is advantageously implemented in any of the sensor technologies listed below (either included pairwise in first and second sensor devices, or each being its own sensor device):

optical time-of-flight;
active IR;
optical triangulation;
light curtain;
stereoscopic camera;
ultrasound echo;
laser; or
microwave radar.

However, other sensor technologies may also be possible, as will be readily understood by a skilled person after having been enlightened by the teachings of this document.

As can be seen in FIG. 8, the principles of the present invention may be applied not only to entrance systems 1 using a single swing door 10, but also to entrance systems using dual swing doors 10, 10'. Elements being labelled "nn" for the right-hand swing door 10' in FIG. 8, where "nn" is 16, S1, PD, S2, PDHA, etc, may be essentially identical to elements being labelled "nn" for the left-hand swing door 10 in FIG. 8—which in turn may be essentially identical to elements having the same reference numerals in FIGS. 6 and 7.

Figure 9:
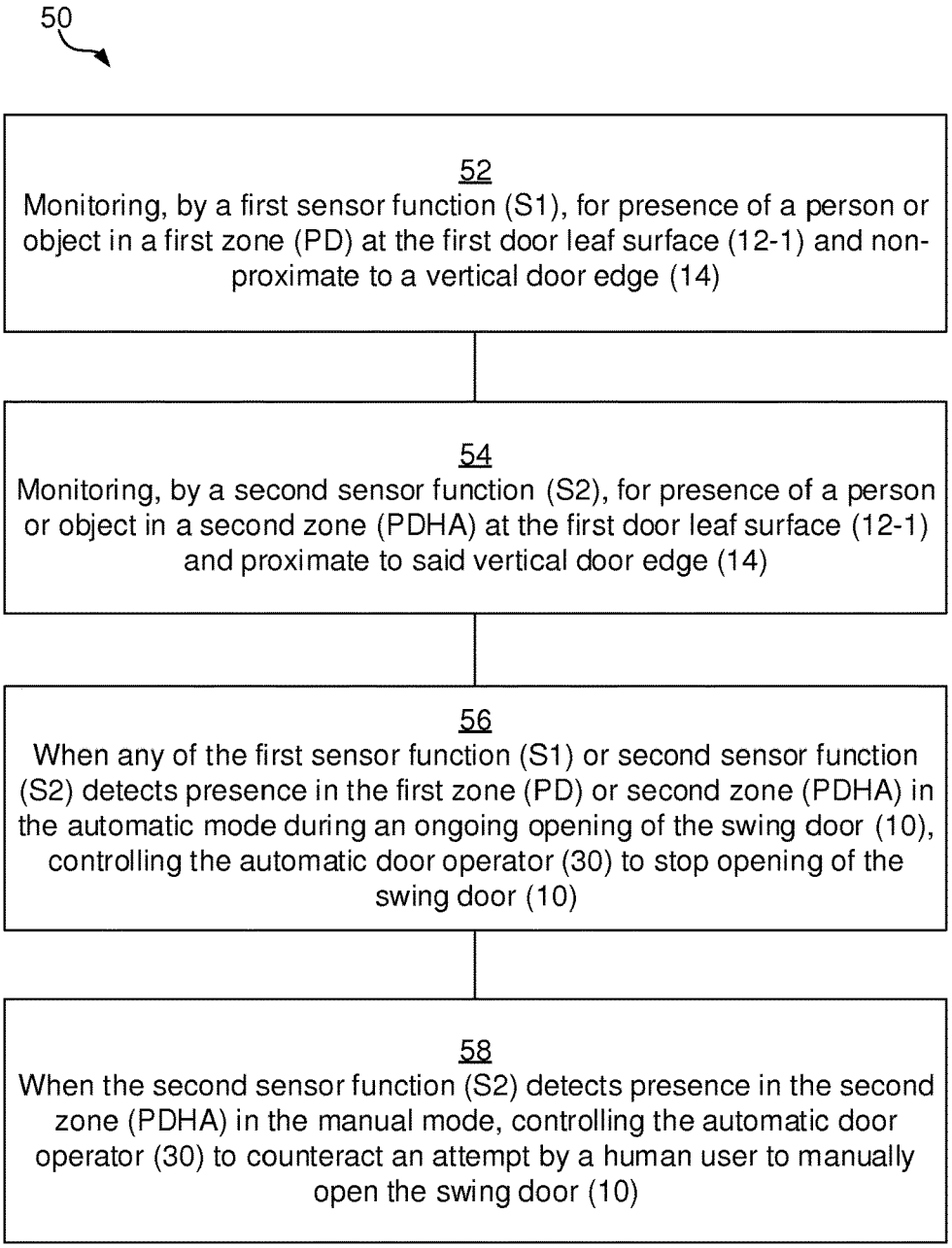
FIG. 9 is a flowchart diagram illustrating a method of providing finger pinch protection at a hinge area of a swing door-based entrance system generally according to the present invention.

FIG. 9 illustrates a method 50 of providing finger pinch protection at a hinge area of a swing door-based entrance system 1 having a motorized automatic door operator 30 for opening 2 of the swing door 10 in an automatic mode of the entrance system 1, wherein the entrance system 1 also has a manual mode in which a human user may cause opening and closing of the swing door 10 by manual force.

The method 50 comprises a first step 52 of monitoring, by the first sensor function S1, for presence of a person or object in the first zone PD at the first door leaf surface 12-1 and non-proximate to the vertical door edge 14. The method 50 also comprises a second step 54 of monitoring, by the second sensor function S2, for presence of a person or object in the second zone PDHA at the first door leaf surface 12-1 and proximate to the vertical door edge 14.

The method 50 further comprises a third step 56, when any of the first sensor function S1 or second sensor function S2 detects presence in the first zone PD or second zone PDHA in the automatic mode during an ongoing opening of the swing door 10, of controlling the automatic door operator 30 to stop opening of the swing door 10. The method 50 moreover comprises a fourth step 58, when the second sensor function S2 detects presence in the second zone PDHA in the manual mode, of controlling the automatic door operator 30 to counteract an attempt by a human user to manually open the swing door 10.

In one or more advantageous embodiments, the method of providing finger pinch protection further comprises monitoring, by the third sensor function S3, for presence of a person or object in the third zone PI at the second door leaf surface 12-2 and non-proximate to the vertical door edge 14, as well as monitoring, by the fourth sensor function S4, for presence of a person or object in the fourth zone PIHA at the second door leaf surface 12-2 and proximate to the vertical door edge 14. When any of the third sensor function S3 or fourth sensor function S4 detects presence in the third zone PI or fourth zone PIHA in the automatic mode during an ongoing closing of the swing door 10, the method may additionally involve controlling the automatic door operator 30 to reopen the swing door 10. Correspondingly, when the fourth sensor function S4 detects presence in the fourth zone PIHA in the manual mode, the method may additionally involve controlling the automatic door operator 30 to counteract an attempt by a human user to manually close the swing door 10.

As has already been described above for some embodiments of the entrance system 1, the method may also involve prioritizing the first and second sensor functions S1, S2 over the third and fourth sensor functions S3, S4, such that the automatic door operator 30 is controlled to reopen the swing door 10 only on condition that none of the first and second sensor functions S1, S2 detects presence in the first zone PD or second zone PDHA in the automatic mode during the ongoing closing of the swing door 10.

The invention has been described above in detail with reference to embodiments thereof. However, as is readily understood by those skilled in the art, other embodiments are equally possible within the scope of the present invention, as defined by the appended claims.

The invention claimed is:

1. An entrance system comprising:

a swing door having opposing first and second door leaf surfaces and being pivotally supported at a vertical door edge by at least one hinge for allowing opening of the swing door from a closed position to an open position with the first door leaf surface being a leading surface and the second door leaf surface being a trailing surface during such opening, as well as for allowing closing of the swing door from the open position to the closed position;

an automatic door operator comprising a motor capable of causing opening of the swing door in an automatic mode of the entrance system, the entrance system also having a manual mode in which a human user may cause opening and closing of the swing door by manual force; and a control arrangement for controlling the automatic door operator, the control arrangement comprising a controller and a plurality of sensor functions for monitoring respective zones at the entrance system for presence of a person or object, wherein the sensor functions comprise:

a first sensor function for monitoring a first zone at the first door leaf surface and non-proximate to said vertical door edge, and a second sensor function for monitoring a second zone at the first door leaf surface and proximate to said vertical door edge;

and wherein the controller is configured to:

when any of the first sensor function or second sensor function detects presence in the first zone or second zone in the automatic mode during an ongoing opening of the swing door, control the automatic door operator to stop opening of the swing door, and when the second sensor function detects presence in the second zone in the manual mode, control the automatic door operator to counteract an attempt by a human user to manually open the swing door.

2. The entrance system as defined in claim 1, wherein the sensor functions further comprise:

a third sensor function for monitoring a third zone at the second door leaf surface and non-proximate to said vertical door edge, and a fourth sensor function for monitoring a fourth zone at the second door leaf surface and proximate to said vertical door edge;

and wherein the controller is further configured to:

when any of the third sensor function or fourth sensor function detects presence in the third zone or fourth zone in the automatic mode during an ongoing closing of the swing door, control the automatic door operator to reopen the swing door, and when the fourth sensor function detects presence in the fourth zone in the manual mode, control the automatic door operator to counteract an attempt by a human user to manually close the swing door.

3. The entrance system as defined in claim 2, wherein the third and fourth sensor functions are two logically different sensor functions which are implemented by a single common physical sensor device being mounted to an upper part of the second door leaf surface near said vertical door edge.

4. The entrance system as defined in claim 2, wherein the third sensor function is implemented as one physical sensor device being mounted to an upper part of the second door leaf surface near said vertical door edge, and wherein the fourth sensor function is implemented as another physical sensor device being mounted to an upper part of the second door leaf surface at or near a vertical central axis of the second door leaf surface.

5. The entrance system as defined in claim 2, wherein each of the first, second, third and fourth sensor functions is implemented in any of the following sensor technologies:

optical time-of-flight;
active IR;
optical triangulation;
light curtain;
stereoscopic camera;
ultrasound echo;
laser; or
microwave radar.

6. The entrance system as defined in claim 2, wherein the controller is configured to prioritize the first and second sensor functions over the third and fourth sensor functions, such that the controller is configured to control the automatic door operator to reopen the swing door only on condition that none of the first and second sensor functions detects presence in the first zone or second zone in the automatic mode during the ongoing closing of the swing door.

7. The entrance system as defined in claim 1, wherein the first and second sensor functions are two logically different sensor functions which are implemented by a single common physical sensor device, the sensor device being mounted to an upper part of the first door leaf surface near said vertical door edge.

8. The entrance system as defined in claim 1, wherein the first sensor function is implemented as one physical sensor device being mounted to an upper part of the first door leaf surface near said vertical door edge, and wherein the second sensor function is implemented as another physical sensor device being mounted to an upper part of the first door leaf surface at or near a vertical central axis of the first door leaf surface.

9. A method of providing finger pinch protection at a hinge area of the entrance system according to claim 1, the method comprising:

monitoring, by the first sensor function, for presence in the first zone at the first door leaf surface and non-proximate to the vertical door edge;

monitoring, by the second sensor function, for presence in the second zone at the first door leaf surface and proximate to said vertical door edge;

when any of the first sensor function or second sensor function detects presence in the first zone or second zone in the automatic mode during the ongoing opening of the swing door, controlling the automatic door operator to stop opening of the swing door; and when the second sensor function detects presence in the second zone in the manual mode, controlling the automatic door operator to counteract an attempt by the human user to manually open the swing door.

10. The method of providing finger pinch protection as defined in claim 9, wherein the entrance system further comprises a third sensor function for monitoring a third zone at the second door leaf surface and non-proximate to said vertical door edge, and a fourth sensor function for monitoring a fourth zone at the second door leaf surface and proximate to said vertical door edge, the method further comprising;

monitoring, by the third sensor function, for presence in the third zone at the second door leaf surface and non-proximate to said vertical door edge;

monitoring, by the fourth sensor function, for presence in the fourth zone at the second door leaf surface and proximate to said vertical door edge;

when any of the third sensor function or fourth sensor function detects presence in the third zone or fourth zone in the automatic mode during the ongoing closing of the swing door, controlling the automatic door operator to reopen the swing door; and when the fourth sensor function detects presence in the fourth zone in the manual mode, controlling the automatic door operator to counteract an attempt by the human user to manually close the swing door.

11. The method of providing finger pinch protection as defined in claim 10, further comprising prioritizing the first and second sensor functions over the third and fourth sensor functions, such that the automatic door operator is controlled to reopen the swing door only on condition that none of the first and second sensor functions detects presence in the first zone or second zone in the automatic mode during the ongoing closing of the swing door.

* * * * *